US010584014B2

(12) United States Patent
Fauconnet et al.

(10) Patent No.: US 10,584,014 B2
(45) Date of Patent: Mar. 10, 2020

(54) ROBUST ELECTRICAL SAFETY ACTUATION MODULE

(71) Applicants: Otis Elevator Company, Farmington, CT (US); Aurelien Fauconnet, Isdes (FR)

(72) Inventors: Aurelien Fauconnet, Isdes (FR); Frederic Beauchaud, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/781,898

(22) PCT Filed: Dec. 7, 2015

(86) PCT No.: PCT/IB2015/002500
§ 371 (c)(1),
(2) Date: Jun. 6, 2018

(87) PCT Pub. No.: WO2017/098299
PCT Pub. Date: Jun. 15, 2017

(65) Prior Publication Data

US 2018/0354749 A1 Dec. 13, 2018

(51) Int. Cl.
*B66B 5/22* (2006.01)
*B66B 5/18* (2006.01)
*B66B 5/04* (2006.01)

(52) U.S. Cl.
CPC ..... *B66B 5/22* (2013.01); *B66B 5/044* (2013.01); *B66B 5/18* (2013.01)

(58) Field of Classification Search
CPC ..... B66B 5/22; B66B 5/044; B66B 5/18
See application file for complete search history.

(56) References Cited

U.S. PATENT DOCUMENTS 3,762,512 A * 10/1973 McIntyre ..... B66B 5/22 188/189
5,096,020 A * 3/1992 Korhonen ..... B66B 5/22 187/359

(Continued)

FOREIGN PATENT DOCUMENTS

CN 102328862 A 1/2012
CN 104609277 A 5/2015

(Continued)

OTHER PUBLICATIONS

International Search Report, International Application No. PCT/IB2015/002500, dated Aug. 8, 2016, European Patent Office; International Search Report 5 pages.

(Continued)

*Primary Examiner* — Michael A Riegelman
(74) *Attorney, Agent, or Firm* — Cantor Colburn LLP

(57) ABSTRACT

An elevator electrical safety actuation system and method are provided. The system includes an actuation device configured to operate a brake device. The actuation device includes a locking mechanism (542), a first portion (534) configured to be engaged and retained by the locking mechanism (542) in a first portion-first state and moveable to a second state wherein the first portion is not retained by the locking mechanism (542), a second portion (536) in contact with the first portion (534) when the second portion (536) is in a second portion-first state and the first portion (534) is in the first portion-first state, the second portion (536) moveable to a second portion-second state, wherein the second portion (536) is operably connected to the brake device, and a resetting mechanism (546) configured to force the first portion (534) from the first portion-second state to the first portion-first state.

9 Claims, 8 Drawing Sheets

(56) References Cited

U.S. PATENT DOCUMENTS 5,873,434 A 2/1999 Sugita et al.
6,039,151 A 3/2000 Ringel et al.
6,161,653 A 12/2000 Skalski et al.
6,371,261 B1 * 4/2002 Thompson ..... B66B 5/22 187/370
6,439,355 B1 8/2002 Kimble
6,471,017 B1 10/2002 Booz et al.
6,719,101 B2 * 4/2004 Hugel ..... B66B 5/22 187/372
7,398,863 B2 7/2008 Liebetrau et al.
7,575,099 B2 8/2009 Oh et al.
7,591,351 B2 9/2009 Fischer et al.
7,753,176 B2 7/2010 Kigawa et al.
8,631,909 B2 1/2014 Draper et al.
8,939,262 B2 1/2015 Schienda et al.
9,027,714 B2 5/2015 Husman et al.
9,321,611 B2 * 4/2016 Wei ..... B66B 5/24
2003/0085078 A1 * 5/2003 Simmonds ..... B66B 5/22 187/373
2004/0262091 A1 * 12/2004 Ito ..... B66B 5/185 187/372
2007/0007083 A1 * 1/2007 Husmann ..... B66B 5/20 187/366
2007/0051563 A1 3/2007 Oh et al.
2010/0163346 A1 * 7/2010 Coquerelle ..... B66B 5/0068 187/247
2011/0272223 A1 * 11/2011 Drayer ..... B66B 5/044 188/65.1
2012/0152658 A1 * 6/2012 Osmanbasic ..... B66B 5/044 187/288
2012/0152663 A1 * 6/2012 Legeret ..... B66B 5/20 187/404
2012/0305338 A1 12/2012 Kocher et al.
2013/0081907 A1 * 4/2013 Meierhans ..... B66B 5/20 187/359
2013/0081908 A1 4/2013 Meierhans et al.
2013/0248296 A1 9/2013 Husmann
2013/0248298 A1 * 9/2013 Osmanbasic ..... B66B 5/20 187/359
2014/0326544 A1 * 11/2014 Husmann ..... B66B 5/18 187/359
2014/0332324 A1 * 11/2014 Husmann ..... B66B 5/20 187/359
2016/0355377 A1 * 12/2016 Husmann ..... B66B 5/18
2017/0001835 A1 * 1/2017 Hu ..... B66B 5/18
2017/0107078 A1 * 4/2017 Hu ..... B66B 5/18
2018/0162694 A1 * 6/2018 Hu ..... B66B 5/22
2018/0222717 A1 * 8/2018 Billard ..... B66B 5/18
2018/0222718 A1 * 8/2018 Khzouz ..... B66B 5/18
2018/0251340 A1 * 9/2018 Fauconnet ..... B66B 5/288
2018/0327224 A1 * 11/2018 Billard ..... B66B 9/00
2018/0354749 A1 * 12/2018 Fauconnet ..... B66B 5/044
2019/0062113 A1 * 2/2019 Hu ..... B66B 9/00
2019/0144240 A1 * 5/2019 Steinhauer ..... B66B 5/22
2019/0177114 A1 * 6/2019 Fargo ..... B66B 1/32

FOREIGN PATENT DOCUMENTS

JP 200922735 10/2009
JP 4990202 B2 8/2012
WO 2013092239 6/2013

OTHER PUBLICATIONS

International Written Opinion, International Application No. PCT/IB2015/002500, dated Aug. 8, 2016, European Patent Office; International Written Opinion 5 pages.

* cited by examiner

ROBUST ELECTRICAL SAFETY ACTUATION MODULE

CROSS REFERENCE TO RELATED APPLICATIONS

This is a U.S. National Stage of Application No. PCT/IB2015/002500, filed on Dec. 7, 2015, the disclosure of which is incorporated herein by reference.

BACKGROUND

The subject matter disclosed herein generally relates to elevator electrical safety actuation systems and methods and, more particularly, to robust elevator electrical safety actuation systems and methods that are independent from a guide rail.

Some machines, such as elevator systems, include safety systems to stop the machine when it rotates at excessive speeds or, in the case of elevator systems, an elevator car travels at excessive speeds in response to an inoperative component. Conventional safety systems include an actively applied safety system that requires power to positively actuate the safety mechanism or a passively applied safety system that requires power to maintain the safety system in a hold operating state. Although passively applied safety systems offer an increase in functionality, such systems typically require a significant amount of power in order to maintain the safety system in a hold operating state, thereby greatly increasing energy requirements and operating costs of the machine. Further, passively applied safety systems typically feature larger components due to the large power requirements during operation, which may adversely affect the overall size, weight, and efficiency of the machine.

Further, some conventional systems are configured to engage with a guide rail of the elevator system, such that actuation and braking may be applied to stop an elevator car or counterweight. Such configurations may be designed to operate specifically with the characteristics of the guide rail, such as be configured to operate effectively with the construction and material of the guide rail (e.g., machined, cold drawn, lubricated, oiled, etc.).

SUMMARY

According to one embodiment, an elevator electrical safety actuation system is provided. The system includes an actuation device configured to operate a brake device. The actuation device includes a locking mechanism, a first portion configured to be engaged and retained by the locking mechanism in a first portion-first state and moveable to a second state wherein the first portion is not retained by the locking mechanism, a second portion in contact with the first portion when the second portion is in a second portion-first state and the first portion is in the first portion-first state, the second portion moveable to a second portion-second state, wherein the second portion is operably connected to the brake device, and a resetting mechanism configured to force the first portion from the first portion-second state to the first portion-first state.

In addition to one or more of the features described above, or as an alternative, further embodiments of the system may include a housing configured to house the actuation device.

In addition to one or more of the features described above, or as an alternative, further embodiments of the system may include that the housing comprises a first housing configured to house the locking mechanism, the first portion, and the second portion, and a second housing configured to house the resetting mechanism.

In addition to one or more of the features described above, or as an alternative, further embodiments of the system may include that the resetting mechanism is an electrical cylinder.

In addition to one or more of the features described above, or as an alternative, further embodiments of the system may include a brake device, wherein movement of the second portion from the second portion-first state to the second portion-second state operates the brake device.

In addition to one or more of the features described above, or as an alternative, further embodiments of the system may include that a linkage operably connects the second portion to the brake device.

In addition to one or more of the features described above, or as an alternative, further embodiments of the system may include a biasing mechanism configured to bias the first portion from the first portion-first state toward the first portion-second state.

In addition to one or more of the features described above, or as an alternative, further embodiments of the system may include at least one guide wherein the first portion and the second portion are configured to move along the guide.

In addition to one or more of the features described above, or as an alternative, further embodiments of the system may include that the locking mechanism is an electromagnet.

According to another embodiment, a method of operating an elevator is provided. The method includes detecting, with a controller, a stopping event, releasing a locking mechanism that is configured to engage and retain a first portion in a first portion-first state, urging a second portion from a second portion-first state to a second portion-second state with the first portion, operating a brake device of the elevator when the second portion moves from the second portion-first state to the second portion-second state, and urging the first portion from the first portion-second state to the first portion-first state with a resetting mechanism configured to force the first portion from the first portion-second state to the first portion-first state.

In addition to one or more of the features described above, or as an alternative, further embodiments of the method may include urging the first portion from the first portion-first state to the first portion-second state with a biasing mechanism when the locking mechanism is released.

In addition to one or more of the features described above, or as an alternative, further embodiments of the method may include engaging stopping an elevator when the brake device is operated.

In addition to one or more of the features described above, or as an alternative, further embodiments of the method may include moving the second portion from the second portion-second state to the second portion-first state after the first portion is returned to the first portion-first state.

In addition to one or more of the features described above, or as an alternative, further embodiments of the method may include locking the first portion in the first portion-first state after urging the first portion from the first portion-second state to the first portion-first state.

In addition to one or more of the features described above, or as an alternative, further embodiments of the method may include that operating the brake device comprises the second portion operating a linkage that operably connects the second portion to the brake device when the second portion moves from the second portion-first state to the second portion-second state.

Technical effects of embodiments of the present disclosure include an electrical safety actuation mechanism configured to operate without the need of a guide rail interface. Further technical effects include a resetting mechanism for an electrical safety actuation mechanism that operates to reset the actuation mechanism after the actuation mechanism is used to engage a safety block.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
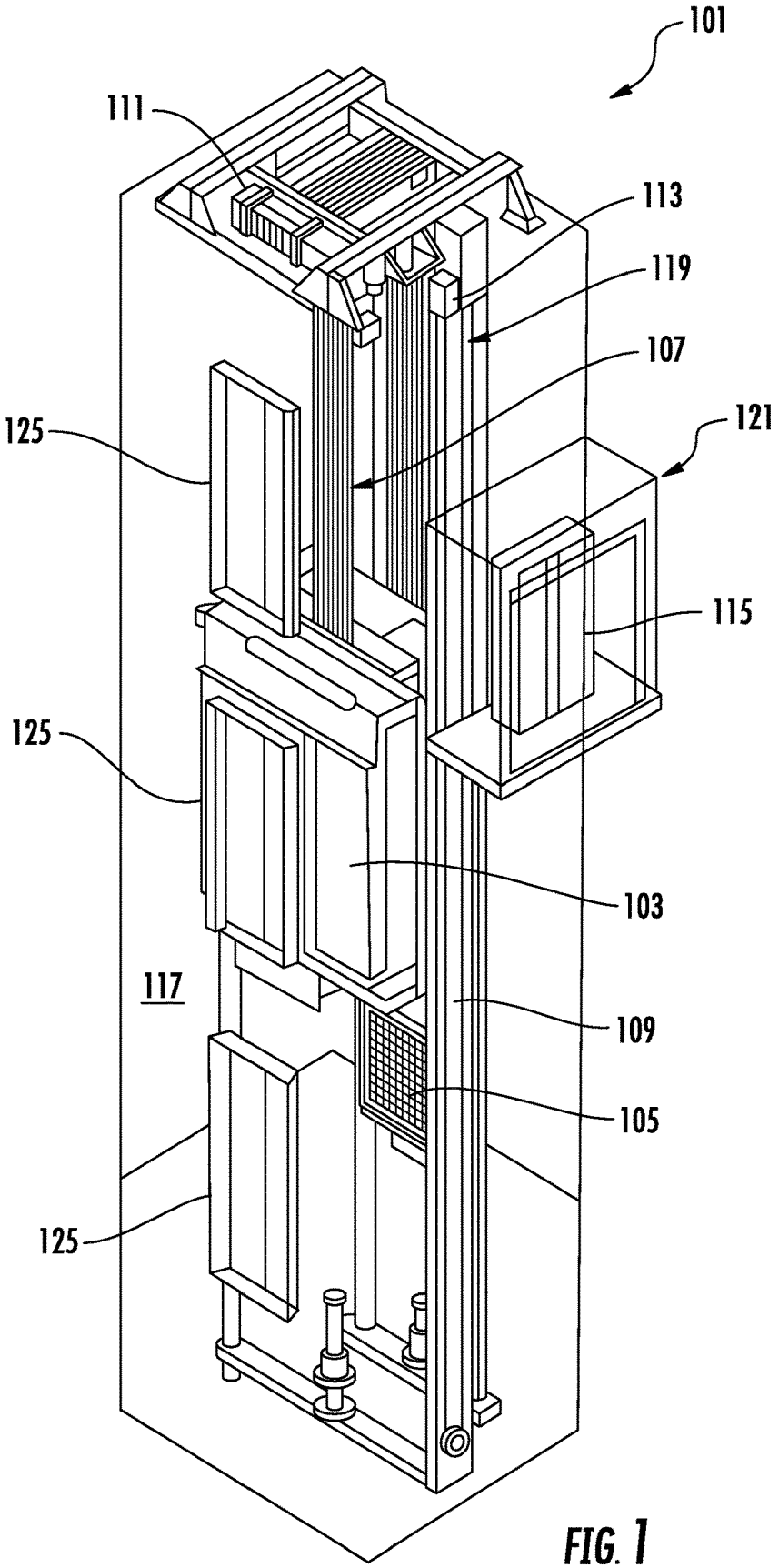
FIG. 1 PRIOR ART
FIG. 1 is a schematic illustration of an elevator system that may employ various embodiments of the disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2A:
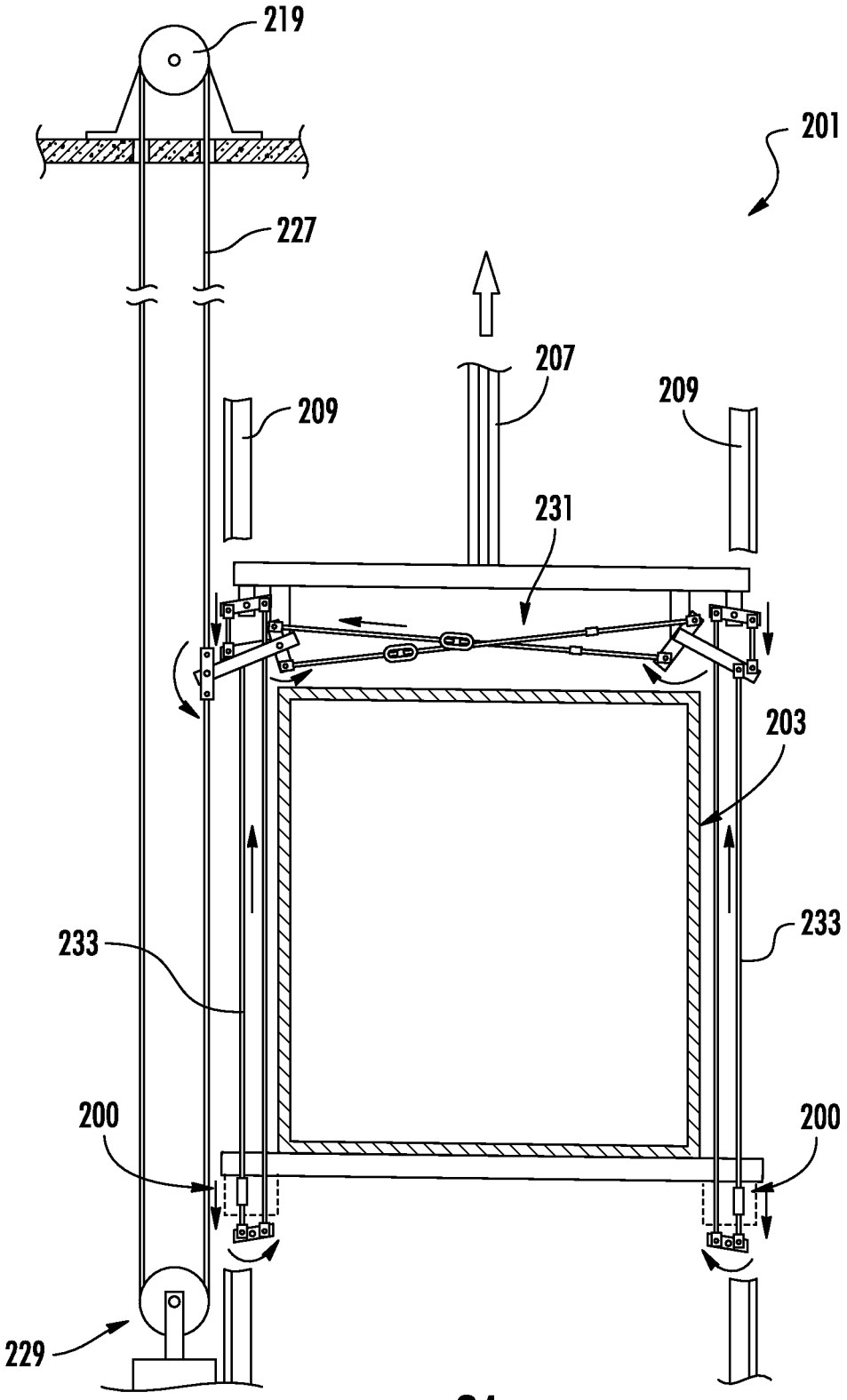
FIG. 2A PRIOR ART
FIG. 2A is a schematic illustration of an emergency braking system of an elevator system.
Figure 2B:
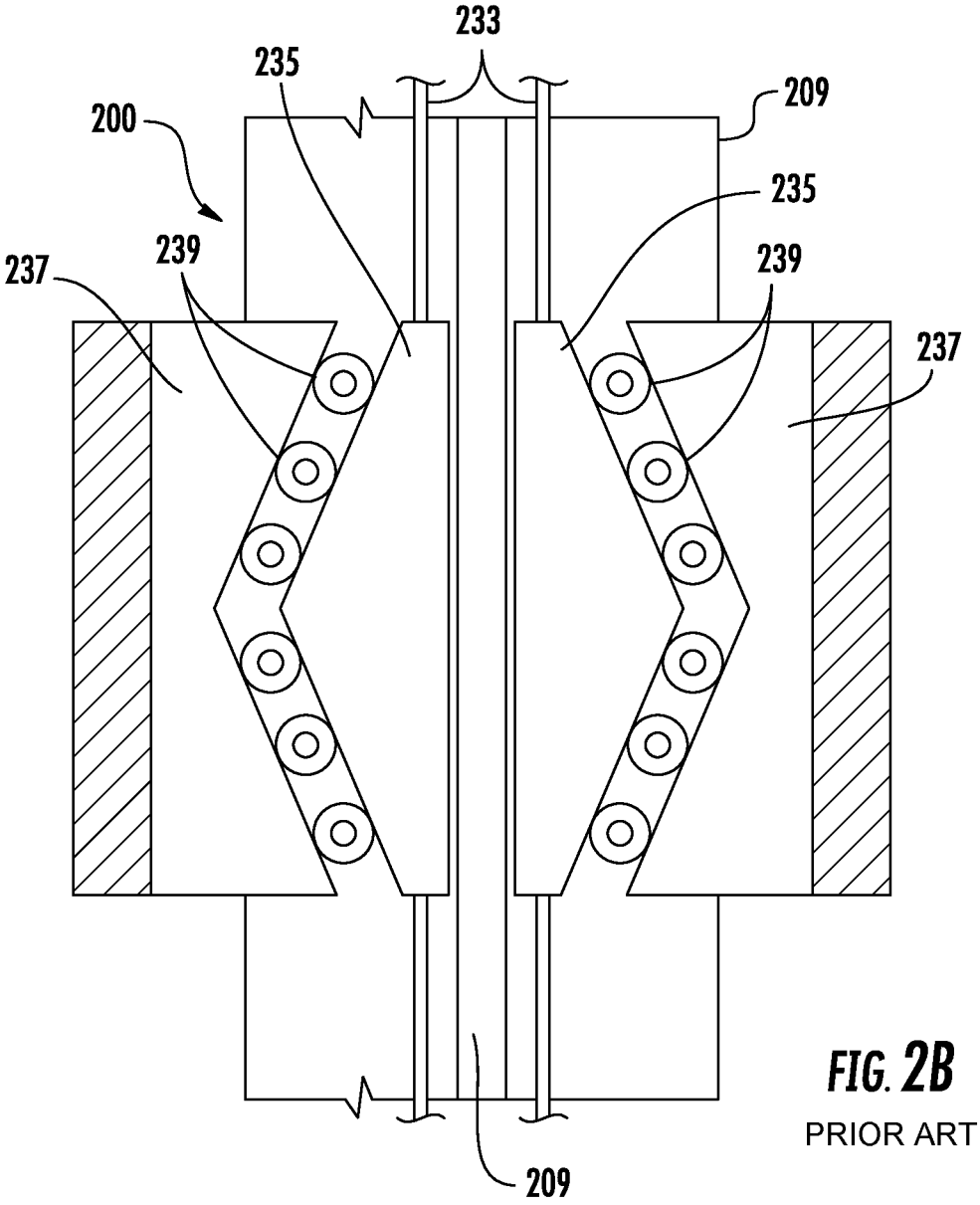
FIG. 2B PRIOR ART
FIG. 2B is an enlarged schematic illustration of an emergency braking system of an elevator system.

Referring to FIGS. 2A and 2B, an example of a conventional elevator safety actuation module 200, e.g., a mechanical mechanism, is shown. FIG. 2A shows an elevator system 201 employing the elevator safety block 200 and FIG. 2B shows as detailed view of the elevator safety block 200. The elevator system 201 includes an elevator car 203, guide rails 209 for guiding the elevator car 203 in upward and downward motion within an elevator shaft along guide rails 209, and roping 207 for raising and lowering the elevator car 203.

The safety mechanism for the elevator car 203 includes a governor 219, an endless governor rope 227, a tension adjuster 229 for the governor rope 227, elevator safety blocks 200 mounted on the elevator car 203 for stopping the elevator car 203 in the event of overspeeding, and a mechanical linkage 231 mounted on the elevator car 203 and connecting the governor rope 227 to the elevator safety blocks 200. The elevator safety blocks 200 are configured to releasably engage with the guide rails 209 to apply a braking force to the elevator car 203 in the event of an overspeed situation.

In operation, as the elevator car 203 starts to overspeed downwardly, the governor rope 227 and governor 219 start to overspeed, thereby tripping the governor 219 which prevents further overspeeding of the governor rope 227. The governor rope 227 moves more slowly than the elevator car 203 thereby tripping the linkage 231. When the linkage 231 is tripped, the configuration pulls upward on actuators 233 which activate the elevator safety blocks 200. When the elevator safety blocks 200 are activated, the elevator safety blocks 200 will engage with the guide rails 209 and stop the elevator car 203.

Referring now to FIG. 2B, a detailed schematic of the elevator safety block 200 is shown. The elevator safety block 200 of FIG. 2 includes two parts, wedges 235 and wedge guides 237 that are configured about the guide rail 209. The wedge guides 237 are mounted in a fixed position relative to the elevator car 203. The wedges 235 are mounted so as to be movable vertically upwardly or downwardly relative to the elevator car 203 and are connected to the linkage 231 by the actuators 233.

During normal operation of the elevator car 203, that is to say when the elevator car 203 is travelling upwardly or downwardly at normal speed, the wedges 235 and wedge guides 237 are not in contact with the guide rail 209. However, if the elevator car 203 overspeeds downwardly thereby operating the linkage 231, the actuators 233 are caused to move upward. The upward motion of the actuators 233 forces the wedges 235 vertically upwardly relative to the wedge guides 237. A set of rollers 239 are provided between the wedge guides 237 and the wedges 235 to permit the relative movement. As the wedges 235 move up relative to the wedge guides 237, the wedges 235 also move horizontally toward the guide rail 209 as a result of the shape of the wedges 235 and wedge guides 237, and engage the elevator car guide rail 209, so as to prevent further movement of the elevator car 203.

Although shown and described with respect to a specific configuration in FIGS. 2A and 2B, those of skill in the art will appreciate that other configurations and/or components and/or features may be possible. Thus, the configuration of FIGS. 2A and 2B are merely provided for illustrative and explanatory purposes. It will be appreciated by those of skill in the art that traditional elevator safety blocks, such as shown in FIG. 2B, incorporate two movable portions positioned on either side of the guide rail.

Electrical safety actuation systems may be used to replace or supplement the above described safety block system, and specifically may replace the mechanical operation of the wedges with an electrical actuation device. In such configurations, a rail grabber or other device may be used activate a safety block and the wedges therein to engage with a guide rail and stop an elevator car during an overspeed event. However, such configurations may be dependent upon the specific configuration of the guide rail of the particular elevator system. As such, a number of variables may influence the safety block operation, including, but not limited to, a guide rail being machined, cold drawn, lubricated, oiled, and/or in-field de-greasing operations performed by field personnel.

Figure 3:
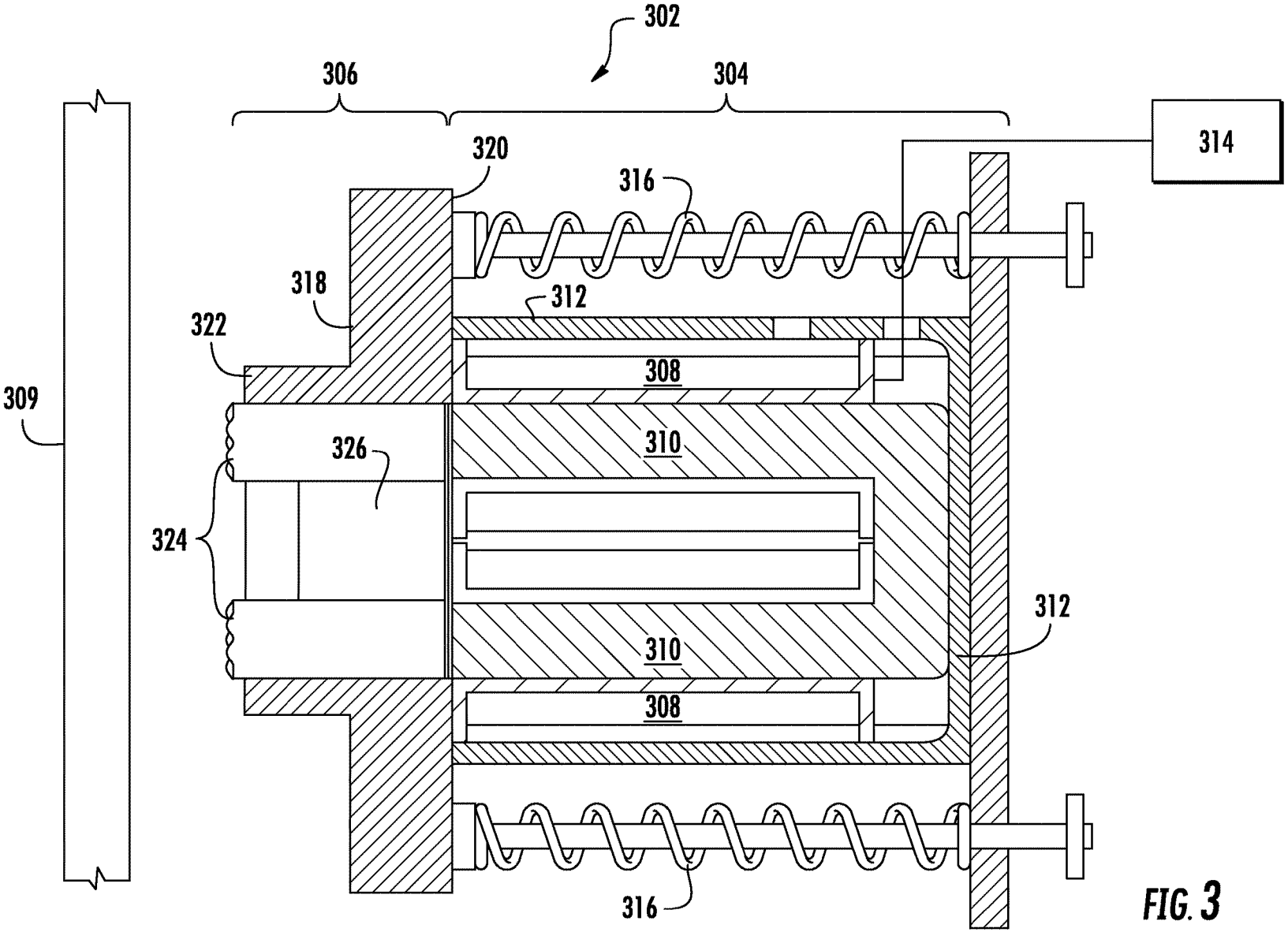
FIG. 3 is a schematic cross-sectional illustration of an electric actuation mechanism of an elevator system.

For example, turning now to FIG. 3 an embodiment of an electrical safety actuator 302 for an elevator safety system in a non-engaging position is shown. The electrical safety actuator 302 includes an electromagnetic component 304 and a magnetic brake 306. The electromagnetic component 304 includes a coil 308 and a core 310 disposed within an actuator housing 312. A safety controller 314 is in electrical communication with the electromagnetic component 304 and is configured to control a supply of electricity to the electromagnetic component 304. In the embodiment shown, the electrical safety actuator 302 further includes at least one biasing member 316. The embodiment of FIG. 2 illustrates two biasing members 316 configured to provide a force to move the magnetic brake 306 in a direction toward a guide rail 309. The biasing members 316, in some embodiments, may be configured as compression springs.

The magnetic brake 306 includes a body 318 having a first end 320 and a second end 322. The body 318 is configured to support and retain a brake portion 324. A magnet 326 is disposed within or adjacent to the magnetic brake 306 and configured to magnetically couple the magnetic brake 306 to the electromagnetic component 304 in a non-engaging position and to a ferromagnetic or paramagnetic component of the system (e.g., guide rail 309) in an engaging position. The electromagnetic component 304 is configured to hold the magnetic brake 306 in the non-engaging position with a hold power that is in a direction away from the guide rail 309. The magnetic brake 306 provides a magnetic attraction force in a direction toward the electromagnetic component 304 to further hold the magnetic brake 306 in the non-engaging position.

For example, in the non-engaging position illustrated in FIG. 3, the magnetic brake 306 is attracted and held to the electromagnetic component 304 with the hold power via the core 310 when the safety controller 314 supplies electrical energy to the coil 308 of the electromagnetic component 304. Additionally, the magnetic attraction force of the magnetic brake 306 to the electromagnetic component 304 combines with the hold power in an additive fashion to hold the magnetic brake 306 in the non-engaging position. In some embodiments, the safety controller 314 may be configured to reduce the hold power by reducing the amount of electrical energy supplied to the electromagnetic component 304 upon, for example, the identification of an overspeed condition. Upon reduction of the hold power, the electromagnetic component 304 is configured to release the magnetic brake 306 into an engaging position, wherein the brake portion 324 engages with a surface of the guide rail 309.

Figure 4:
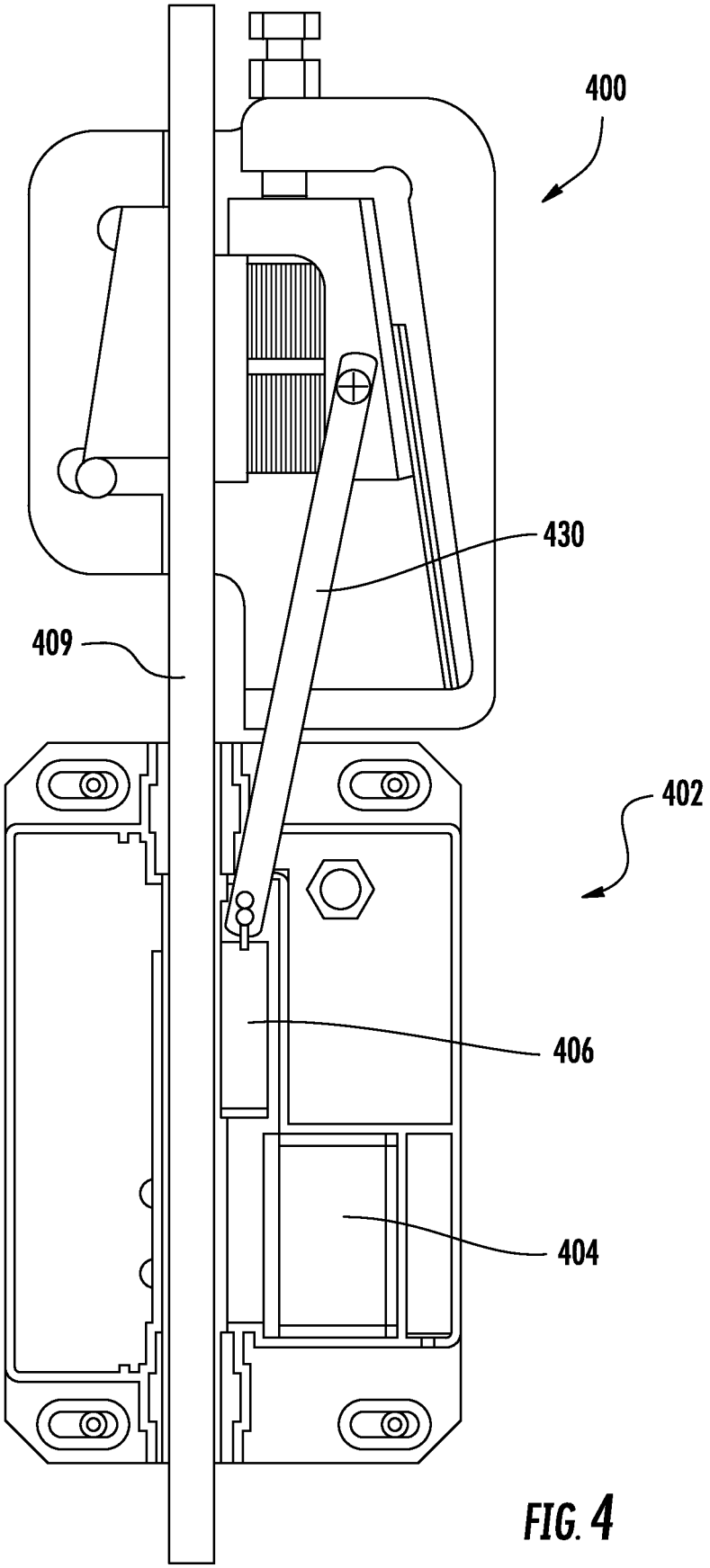
FIG. 4 is a schematic illustration of an electric actuation mechanism and operably connected safety block of an elevator system.

Turning now to FIG. 4, an example configuration of an electrical safety actuation system is shown. As shown in FIG. 4, a magnetic brake 406 of an electrical safety actuator 402 is magnetically attached to a guide rail 409. FIG. 4 illustrates the attached magnetic brake 406 positioned above an electromagnetic component 404 of the electrical safety actuator 402 after moving upward with the guide rail 409 relative to a descending elevator car (not shown). The magnetic brake 406 is operably coupled to a safety block 400 by a linkage 430.

As will be appreciated by those of skill in the art, the operation of the electrical safety actuator as described above may rely on the compatibility between the magnetic brake 406 and the guide rail 409. If there is any issue of the magnetic brake 406 gripping and engaging with the guide rail 409, the safety block 400 may not properly engage. For example, if too much oil or grease is applied to the guide rail 409, it may be difficult for the magnetic brake 406 to engage with a surface of the guide rail 409, and the operation of the safety block 400 may be delayed.

Thus, in accordance with embodiments provided herein, a mechanism for operating and resetting a safety block that is independent of a guide rail is provided. For example, turning to FIG. 5, a schematic illustration of an electrical safety actuation device for a safety block is shown. As shown, an electrical safety actuator 502 is operably connected to a safety block 500 by a linkage 530. A guide rail that is engageable by the safety block 500 is not show for simplicity. The electrical safety actuator 502 may be mounted to or attached to a frame of an elevator car (not shown).

Figure 5:
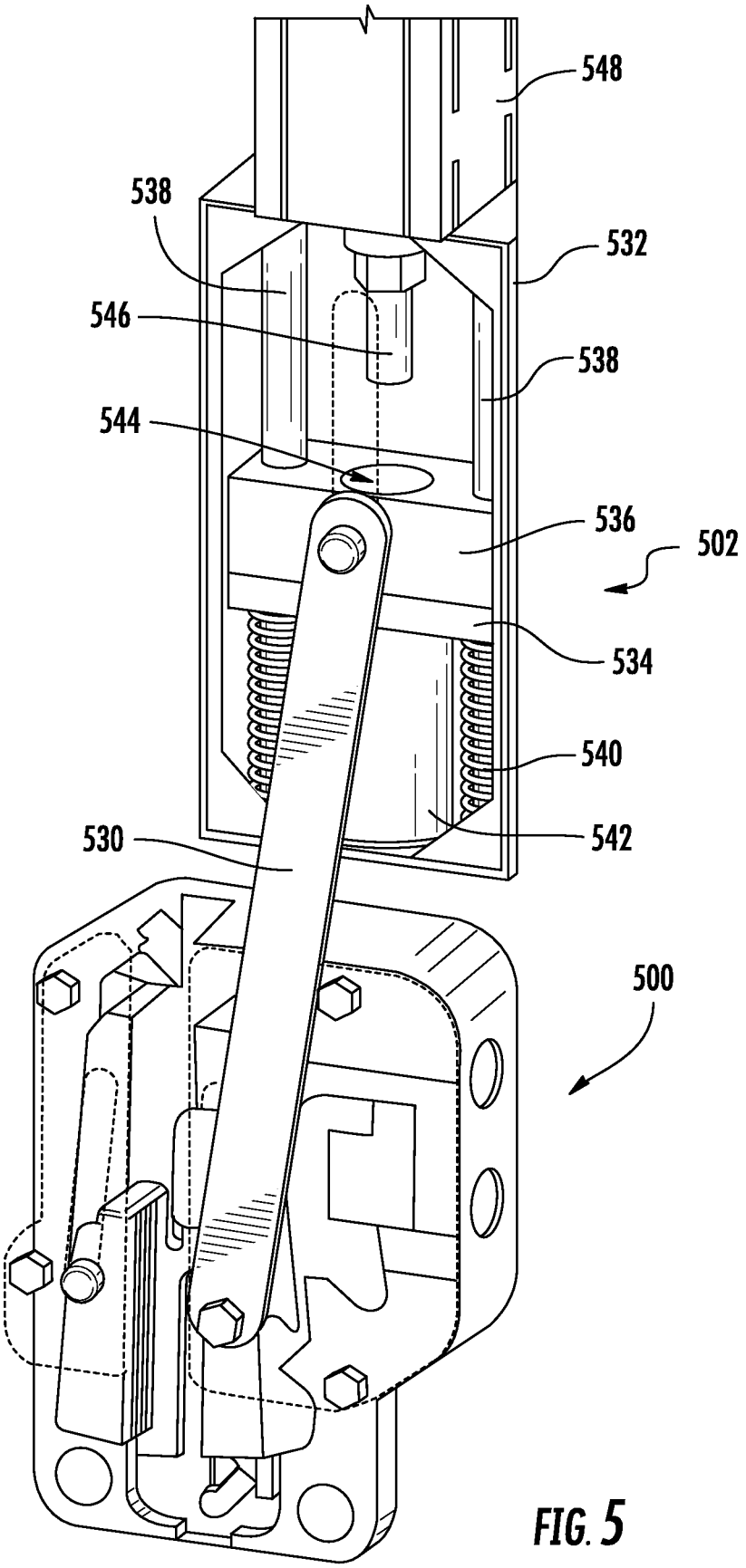
FIG. 5 is a perspective schematic illustration of an electric safety actuation mechanism and safety block in accordance with an embodiment of the present disclosure.

The electrical safety actuator 502 includes a first housing 532 which may support components of the electrical safety actuator 502. As shown, the electrical safety actuator 502 includes a first portion 534 and a second portion 536 that are configured to move within the first housing 532. The first portion 534 and the second portion 536 may be in contact, but separable, as shown in FIG. 5, and may move within the first housing 532 along one or more guides 538. In some embodiments, the first portion 534 and the second portion 536 may independently and separately move within the first housing 532 along the one or more guides 538. The second portion 536 may be operably connected or attached to the linkage 530, and thus the second portion 536 may be operably connected to the safety block 500.

At least one biasing mechanism 540 may be configured within the first housing 532 and in contact with or attached to the first portion 534. In some embodiments, for example as shown in FIG. 5, the biasing mechanism 540 may be arranges as a spring mechanism that wraps around and runs along a guide 538 within the first housing 532. The biasing mechanism 540 may be configured in a fashion to apply a force to the first portion 534 in the direction of the second portion 536. For example, in the arrangement shown in FIG. 5, the biasing mechanism 540 may be biased to apply a force upward or along the guides 538.

Further, a locking mechanism 542 is contained with the first housing 532 and in operable communication with the first portion 534. The locking mechanism 542 may be an electromagnet that is configured to magnetically attach to or otherwise engage with the first portion 534 and hold and/or retain the first portion 534 in a first state or first state (shown in FIG. 5). Upon application of an electrical signal, the locking mechanism 542 may release the first portion 534, and the biasing mechanism 540 may apply a force to push the first portion 534 against the second portion 536, and the first and second portions 534, 536 may be forced away from the locking mechanism 542. Although described with respect to the locking mechanism 542 configured as an electromagnet, those of skill in the art will appreciate that other types of locking mechanisms, including but not limited to mechanical locks or mechanical mechanisms may be used without departing from the scope of the present disclosure.

The second portion 536 may include an aperture 544 passing therethrough in a movement direction of the second portion 536. The aperture 544 may be configured to receive a portion of a resetting mechanism 546. The resetting mechanism 546 may be configured as a piston or cylinder housed within a second housing 548 that is attached to or continuous with the first housing 532. The resetting mechanism 546 may be configured to extend from the second housing 548 into the first housing 532. The resetting mechanism 546 may be configured to engage with one or both of the first portion 534 and the second portion 536. In some embodiments, the resetting mechanism 546 may be configured to pass through the aperture 544 in the second portion 536 and engage with the first portion 534, such that the resetting mechanism 546 may push or apply force or pressure upon the first portion until it contacts and/or engages with the locking mechanism 542.

Turning now to FIGS. 6A-6E, operation of an electrical safety actuator 602 in accordance with a non-limiting embodiment of the present disclosure is shown. FIGS. 6A-6E show the movement of various components of an electrical safety actuator 602 in accordance with an embodiment. Although not shown, a second portion 636 of the electrical safety actuator 602 is operably connected to a safety block or other device by mean of a linkage.

Figures 6A, 6B, 6C, 6D, 6E:
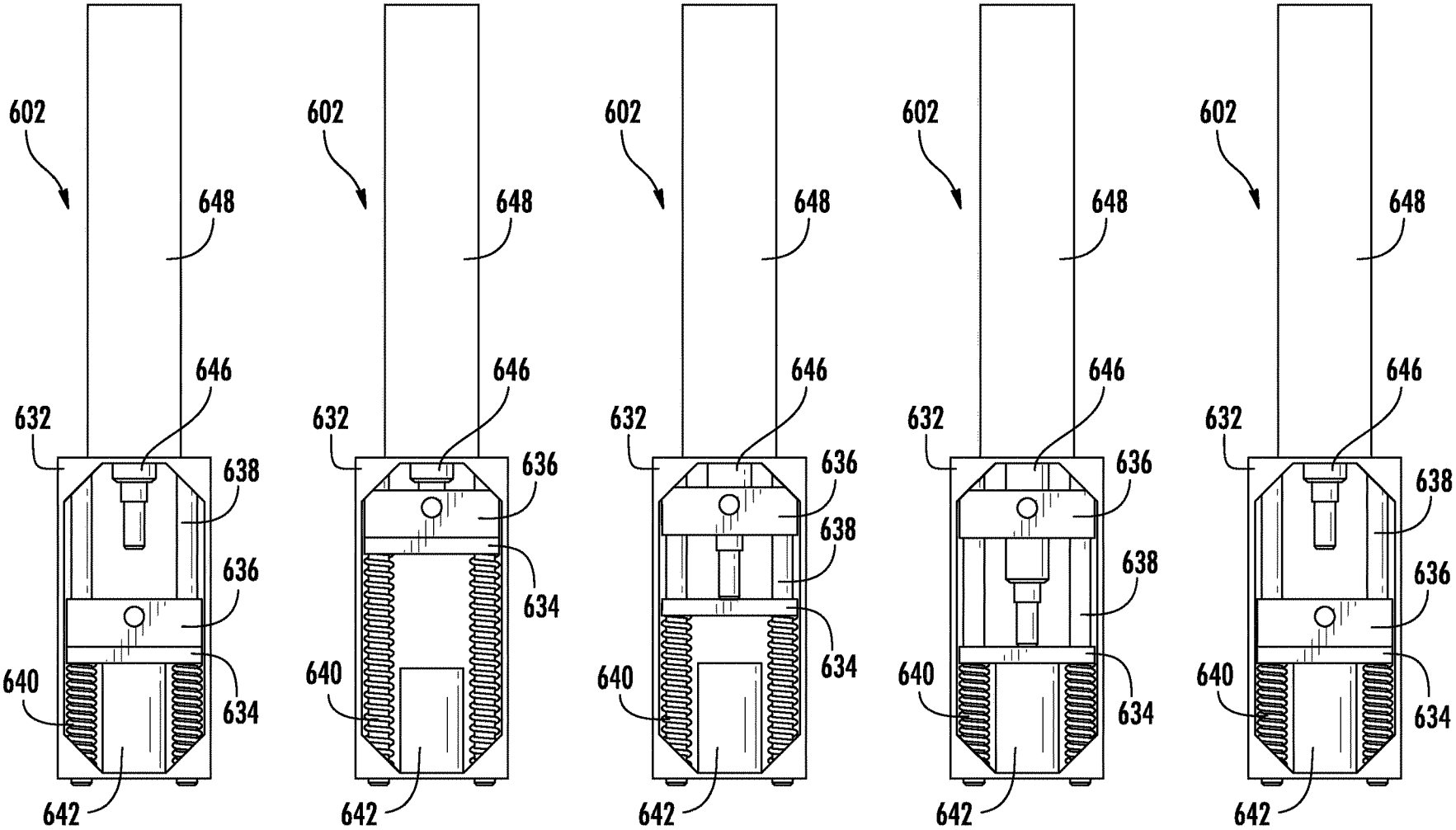
FIG. 6A is a schematic illustration of an electric safety actuation mechanism of the present disclosure.
FIG. 6B is a schematic illustration of the electric safety actuation mechanism of FIG. 6A showing an operation of the electric safety actuation mechanism.
FIG. 6C is a schematic illustration of the electric safety actuation mechanism of FIG. 6A showing an operation of the electric safety actuation mechanism.
FIG. 6D is a schematic illustration of the electric safety actuation mechanism of FIG. 6A showing an operation of the electric safety actuation mechanism.
FIG. 6E is a schematic illustration of the electric safety actuation mechanism of FIG. 6A showing an operation of the electric safety actuation mechanism.

FIG. 6A shows a first portion 634 in a first state and a second portion 636 in a first state. Similarly, a biasing mechanism 640 is in a first state and a resetting mechanism 546 is in a first state. As such, the electrical safety actuator 602 is in a first state. The first state of the electrical safety actuator 602 may an operating or run position such that an elevator may operate within an elevator shaft normally. That is, in the first state of the electrical safety actuator 602, the electrical safety actuator 602 does not interfere with operation or movement of an elevator car. In the first state, a locking mechanism 642 may engage with the first portion 634 and hold or retain the first portion 634 in the first state. As such, the first portion 634 may compress the biasing mechanism 640 and retain or hold the biasing mechanism 640 in the first state.

In an emergency situation, such as an overspeed event, the electrical safety actuator 602 may operate to engage a safety block to stop an elevator car. For example, as shown in FIG. 6B, the electrical safety actuator 602 is shown in an engaged position such that the second portion 636 may operate a connected safety block. The operation of the safety block is achieved by the second portion 636 moving along guides 638 within a first housing 632 such that the second portion 636 may apply a force on a linkage and thus engage the connected safety block.

For example, if an overspeed event is detected, a controller (e.g., safety controller 314 shown in FIG. 3) may apply an electrical signal to the locking mechanism 642. The electrical signal may prompt the locking mechanism 642 to disengage from the first portion 634. With the locking mechanism 642 disengaged from the first portion 634, the biasing mechanism 640 may transition to a second state or position (shown in FIG. 6B). For example, the second state of the biasing mechanism 640 may be an extended position or configuration. The transition of the biasing mechanism 640 from the first state to the second state pushes the first portion 634 along the guides 638. The first portion 634 urges or pushes the second portion 636 along guides 638 within the first housing 632, which applies a force to a connected linkage to operate a safety block (e.g., as shown in FIG. 5, linkage 530 and safety block 500). In one non-limiting example, the electrical signal applied to the locking mechanism 642 may be configured to disable a magnetic force applied by the locking mechanism 642 to the first portion 634.

After an elevator is stopped by the safety block, the electrical safety actuator 602 needs to be reset, such that the electrical safety actuator 602 may be used again to stop an elevator during an overspeed event and/or engage a safety block for other reason (such as a maintenance operation).

Turning to FIG. 6C, part of a reset operation is shown. In FIG. 6C, a resetting mechanism 646 is shown moving from a first state (FIG. 6A) toward a second state (FIG. 6D). The resetting mechanism 646 may be configured as a piston or cylinder that is configured to pass through the second portion 636 and engage with the first portion 634, such as by passing through an aperture in the second portion 636. The resetting mechanism 646 is configured to apply a force to the first portion 634 to move the first portion 634 from the second state (FIG. 6B) back to the first state (FIG. 6A) along the guides 638. As shown, the second portion 636 remains in the second state while the first portion 634 is moved by the resetting mechanism 646. That is, during the resetting process, a safety block may remain engaged with a guide rail such that the elevator cannot move within an elevator shaft.

Turning to FIG. 6D, the resetting mechanism 646 is shown in a second state, such as fully extended, and the first portion 634 is returned to the first state of the first portion 634. Again, as shown in FIG. 6D, the second portion 636 remains in the second state to keep a safety block engaged with a guide rail. The force applied by the resetting mechanism 646 may be greater than an extension force of the biasing mechanism 640 such that the resetting mechanism 646 applies a force to the first portion 634 to compress the biasing mechanism 640. With the first portion 634 returned to the first state, the locking mechanism 642 may re-engage with the first portion 634.

When the safety block is disengaged by operation as known in the art, the second portion 636 may return to the first state, as shown in FIG. 6E. For example, machine torque may be used to disengage the safety block operably connected to the second portion. When the safety block disengages from a guide rail, the second portion 636 returns to the first position, e.g., by gravity, and the elevator may operate normally and the electrical safety actuator 602 and operably connected safety block may be reset to stop an elevator in an overspeed event or to hold the elevator in a maintenance operation, or engage for other reasons.

Figure 7:
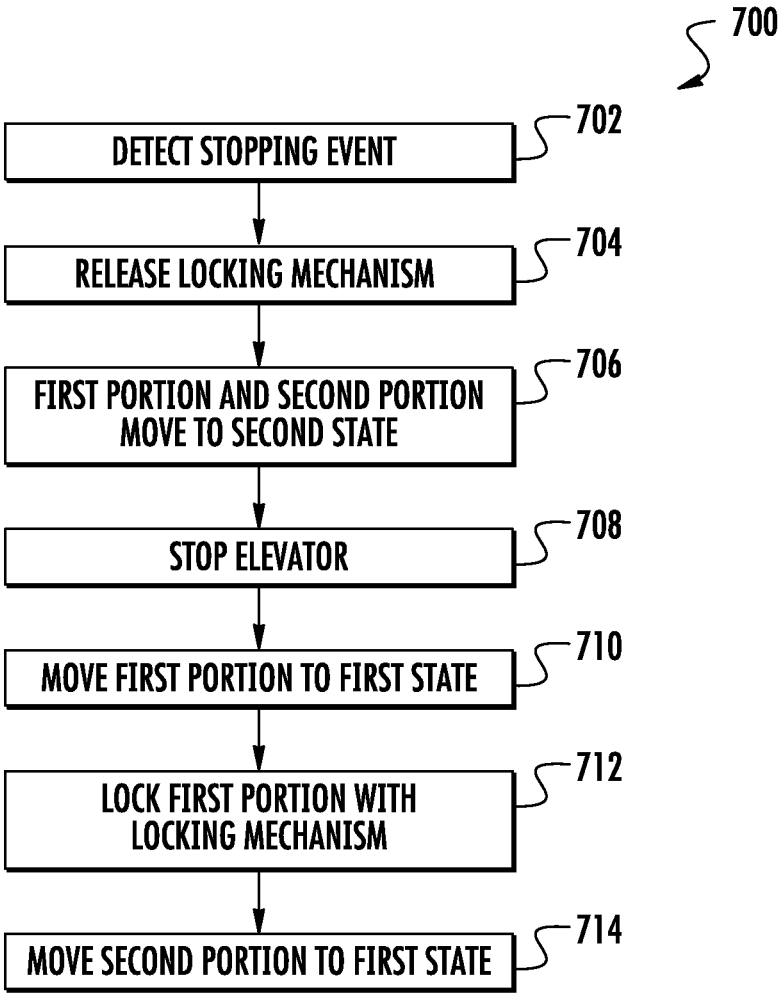
FIG. 7 is a flow process of operating an elevator in accordance with an embodiment of the present disclosure.

Turning now to FIG. 7, a flow process for operating an elevator car or counterweight in accordance with a non-limiting embodiment of the present disclosure is shown. The flow process may be performed by an elevator and/or elevator system configured with one or more safety blocks and an electrical safety actuation device configured to operate the safety block, such as in one or more of the embodiments described above, although other configurations may employ flow process 700 without departing from the scope of the present disclosure.

At block 702, a stopping event may be detected. A stopping event may include an overspeed event wherein emergency stopping may be necessary and/or a maintenance command to lock or stop an elevator car or counterweight such that maintenance may be performed.

When the stopped event is detected at block 702, a locking mechanism in an electrical safety actuation device may be released at block 704. That is, a locking mechanism that retains a component in a first state or first position may be released such that the component may move from the first state or first position to a second state or second position. For example, the locking mechanism may retain a portion of an actuator or other device that is operably connected to a safety block of an elevator system.

When the locking mechanism is released (such as demagnetized) a first portion and a second portion of the electrical safety actuation device may move from the first state or first position to the second state or second position, as shown at block 706. The movement may be forced by a biasing mechanism that is configured to bias the first portion toward the second portion and away from the locking mechanism. For example, the biasing mechanism may be a spring that urges the first portion away from the locking mechanism, and the second portion is forced to move by movement of the first portion.

The movement of the first portion and the second portion into the second state may engage a safety block, and thus stop the elevator, as shown at block 708. For example, the second portion may be operably connected to a safety block such that when the second portion moves from the first state to the second state, the second portion operates on a linkage that is connected to the safety block. When the linkage is operated, the safety block engages with guide rail of the elevator system to stop the elevator car.

When it is desired to have the elevator return to service and/or move the elevator within an elevator shaft, the first portion may be moved from the second state to the first state, as shown at block 710. The movement of the first portion may be by operation of a resetting mechanism that urges the first portion from the second state to the first state. For example, the resetting mechanism may be an electrical cylinder or piston that may be electrically controlled to apply force on the first portion. The resetting mechanism may apply a force to the first portion that is greater than and against the force of the biasing mechanism. During this operation, the second portion may remain in the second state such that the operably connected safety block remains engaged.

With the first portion returned to the first state, the first portion may be locked or engaged by the locking mechanism, as shown at block 712. For example, if the locking mechanism is an electromagnet, the electromagnet may be controlled to enable magnetic retention of the first portion in the first state.

With the first portion returned to the first state, and locked in the first state, the second portion may be moved from the second state to the first state, as shown at block 714. Moving of the second portion may be by the force of gravity. That is, for example, after the safety block is disengaged from the guide rail, the second portion may return to the first state without further action. However, in some embodiments, the second portion may be urged or forced from the second state to the first state by operation of the same or a different resetting mechanism used to move the first portion from the second state to the first state.

As will be appreciated by those of skill in the art, although flow process 700 provides a particular order of steps, this is not intended to be limiting. For example, various steps may be performed in a different order and/or various steps may be performed simultaneously. For example, blocks 704-708 may occur substantially simultaneously in the event of an emergency, without departing from the scope of the present disclosure. Further, for example, blocks 710-714 may occur substantially simultaneously.

Advantageously, embodiments described herein provide an electrical safety actuation mechanism that may provide effective elevator stopping while being independent of a guide rail of the elevator system. For example, various embodiments provided herein are configured to actuate a safety block of an elevator system without the electrical safety actuation mechanism being connected to or in contact with the guide rail. Thus, advantageously, embodiments provided herein may provide an electrical safety actuation mechanism that doesn't depend on features and/or characteristics of the guide rail for operation.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

For example, although the locking mechanism described and shown herein is configured as an electromagnet, those of skill in the art will appreciate that other types of locking mechanisms, electrical and/or mechanical, may be used without departing from the scope of the present disclosure. Further, although the biasing mechanism is shown and described herein as a spring, those of skill in the art will appreciate that other types of biasing mechanisms may be used without departing from the scope of the present disclosure. For example, pistons and/or biasing mechanism configured to apply forces in different directions may be used without departing from the scope of the present disclosure. Moreover, one type of resetting mechanism, configured as an electrical cylinder or piston is described herein, but those of skill in the art will appreciate that other types of resetting systems and mechanisms may be employed without departing from the scope of the present disclosure.

Accordingly, the present disclosure is not to be seen as limited by the foregoing description, but is only limited by the scope of the appended claims.

What is claimed is:

1. An elevator electrical safety actuation system comprising:

an actuation device configured to operate a brake device, wherein the actuation device comprises:

a locking mechanism;

a first portion configured to be engaged and retained by the locking mechanism in a first portion-first state and moveable to a first portion-second state wherein the first portion is not retained by the locking mechanism;

a second portion in contact with the first portion when the second portion is in a second portion-first state and the first portion is in the first portion-first state, the second portion moveable to a second portion-second state, wherein the second portion is operably connected to the brake device; and a resetting mechanism configured to force the first portion from the first portion-second state to the first portion-first state, wherein the second portion is configured to remain in the second portion-second state while the first portion is movable by the resetting mechanism.

2. The system of claim 1, further comprising a housing configured to house the actuation device.

3. The system of claim 2, wherein the housing comprises a first housing configured to house the locking mechanism, the first portion, and the second portion, and a second housing configured to house the resetting mechanism.

4. The system of claim 1, wherein the resetting mechanism is an electrical cylinder.

5. The system of claim 1, wherein movement of the second portion from the second portion-first state to the second portion-second state operates the brake device.

6. The system of claim 5, wherein a linkage operably connects the second portion to the brake device.

7. The system of claim 1, further comprising a biasing mechanism configured to bias the first portion from the first portion-first state toward the first portion-second state.

8. The system of claim 1, further comprising at least one guide wherein the first portion and the second portion are configured to move along the guide.

9. The system of claim 1, wherein the locking mechanism is an electromagnet.

* * * * *